US009259927B2

(12) United States Patent
Miyazaki

(10) Patent No.: US 9,259,927 B2
(45) Date of Patent: Feb. 16, 2016

(54) LIQUID DISCHARGE HEAD, IMAGE FORMING APPARATUS, AND METHOD FOR MANUFACTURING LIQUID DISCHARGE HEAD

(71) Applicant: Takeshi Miyazaki, Kanagawa (JP)

(72) Inventor: Takeshi Miyazaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/659,677

(22) Filed: Mar. 17, 2015

(65) Prior Publication Data

US 2015/0266295 A1 Sep. 24, 2015

(30) Foreign Application Priority Data

Mar. 18, 2014 (JP) ..... 2014-054343
Nov. 22, 2014 (JP) ..... 2014-237210

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/04563* (2013.01); *B41J 2/14233* (2013.01); *B41J 2/1607* (2013.01)

(58) Field of Classification Search
CPC .. B41J 2/14233; B41J 2/04563; B41J 2/0454; B41J 2/04553
See application file for complete search history.

(56) References Cited

U.S. PATENT DOCUMENTS 7,445,314 B2 * 11/2008 Lee et al. ..... 347/45
2013/0016152 A1 1/2013 Nonoyama et al.

FOREIGN PATENT DOCUMENTS

| | | |
|---|---|---|
| JP | 2000-103061 | 4/2000 |
| JP | 2004-082542 | 3/2004 |
| JP | 2005-238846 | 9/2005 |
| JP | 2006-205735 | 8/2006 |
| JP | 2008-080622 | 4/2008 |
| JP | 2013-018279 | 1/2013 |

* cited by examiner

*Primary Examiner* — Juanita D Jackson
(74) *Attorney, Agent, or Firm* — Cooper & Dunham LLP

(57) ABSTRACT

A liquid discharge head includes a channel plate, a diaphragm member, a piezoelectric element, and a temperature detector. The channel plate includes an individual liquid chamber in communication with a nozzle to discharge a droplet. The diaphragm member forms part of a wall face of the individual liquid chamber. The piezoelectric element is disposed on the diaphragm member and includes a lower electrode, a piezoelectric substance, and an upper electrode. The temperature detector is disposed on the diaphragm member and includes an electrode layer formed on the diaphragm member and a piezoelectric substance layer formed on the electrode layer.

5 Claims, 8 Drawing Sheets

LIQUID DISCHARGE HEAD, IMAGE FORMING APPARATUS, AND METHOD FOR MANUFACTURING LIQUID DISCHARGE HEAD

CROSS-REFERENCE TO RELATED APPLICATIONS

This patent application is based on and claims priority pursuant to 35 U.S.C. §119(a) to Japanese Patent Application No. 2014-054343, filed on Mar. 18, 2014 and Japanese Patent Application No. 2014-237210 filed on Nov. 22, 2014, in the Japan Patent Office, the entire disclosures of which are hereby incorporated by reference herein.

BACKGROUND

1. Technical Field

Embodiments of the present disclosure relate to a liquid discharge head, an image forming apparatus including the liquid discharge head, and a method for manufacturing the liquid discharge head.

2. Description of the Related Art

Image forming apparatuses are used as printers, facsimile machines, copiers, plotters, or multifunction peripherals having two or more of the foregoing capabilities. As one type of image forming apparatus employing a liquid-ejection recording system, inkjet recording apparatuses are known that use recording heads (liquid ejection heads or liquid-droplet ejection heads) for ejecting liquid droplets.

For example, a liquid discharge head has a temperature detection unit (also referred to as a resistance temperature detector) is known, where the temperature of the head is detected by an electrode formation layer that forms a lower electrode of a piezoelectric element.

SUMMARY

In at least one aspect of this disclosure, there is provided an improved liquid discharge head including a channel plate, a diaphragm member, a piezoelectric element, and a temperature detector. The channel plate includes an individual liquid chamber in communication with a nozzle to discharge a droplet. The diaphragm member forms part of a wall face of the individual liquid chamber. The piezoelectric element is disposed on the diaphragm member and includes a lower electrode, a piezoelectric substance, and an upper electrode. The temperature detector is disposed on the diaphragm member and includes an electrode layer formed on the diaphragm member and a piezoelectric substance layer formed on the electrode layer.

In at least one aspect of this disclosure, there is provided an improved image forming apparatus including the liquid discharge head.

In at least one aspect of this disclosure, there is provided an improved method for manufacturing the liquid discharge head. The method includes the steps of forming a first layer on the diaphragm member, forming a second layer on the first layer, processing the second layer to form the piezoelectric substance and the piezoelectric substance layer, and etching the first layer with the piezoelectric substance layer serving as an etching-resistant layer, to form the electrode layer.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
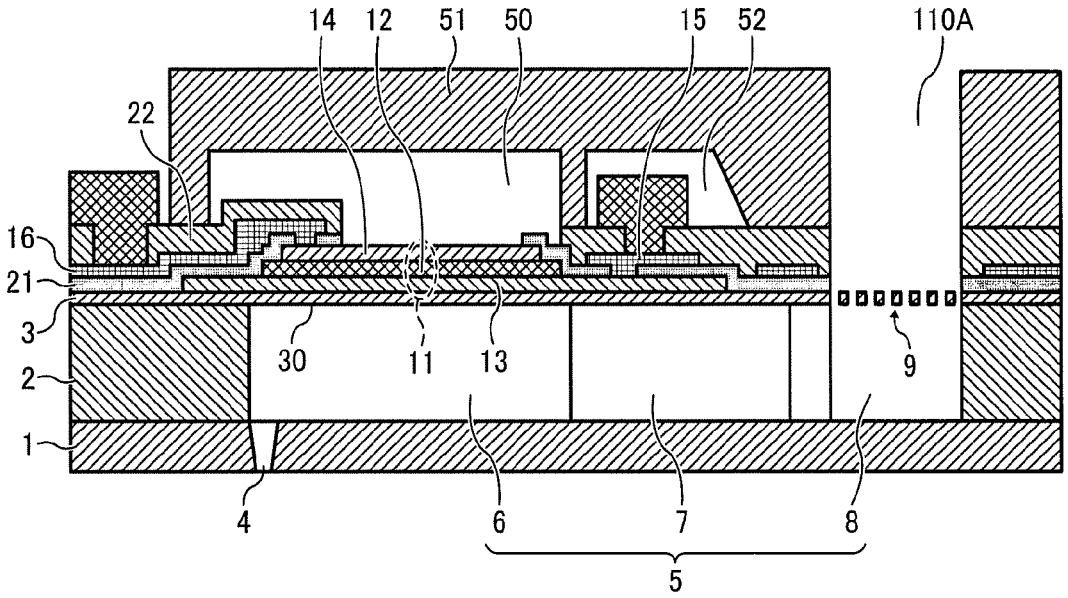
FIG. 1 is a partial cross-sectional view in a direction perpendicular to a nozzle array direction of a first embodiment of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
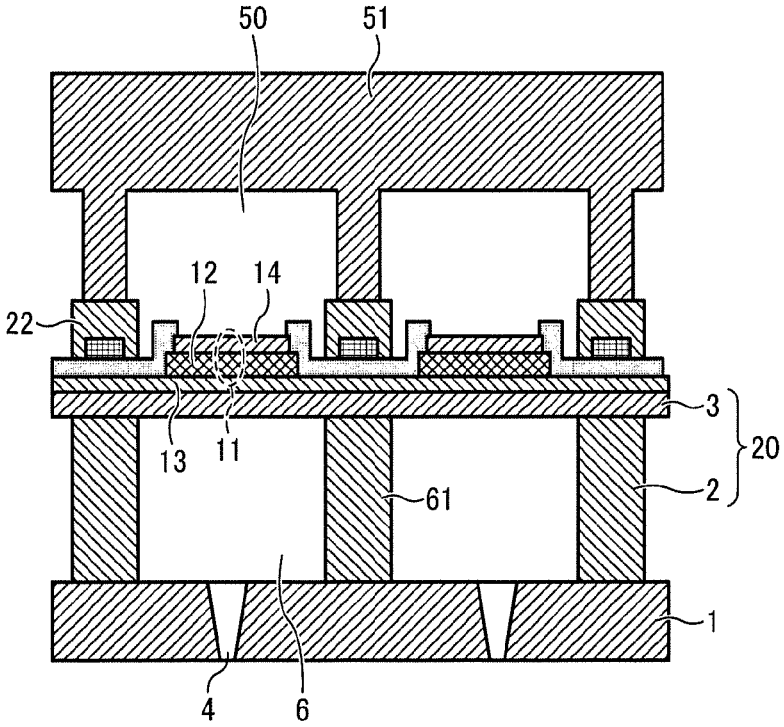
FIG. 2 is a partial cross-sectional view in the nozzle array direction of the head.
Figure 3:
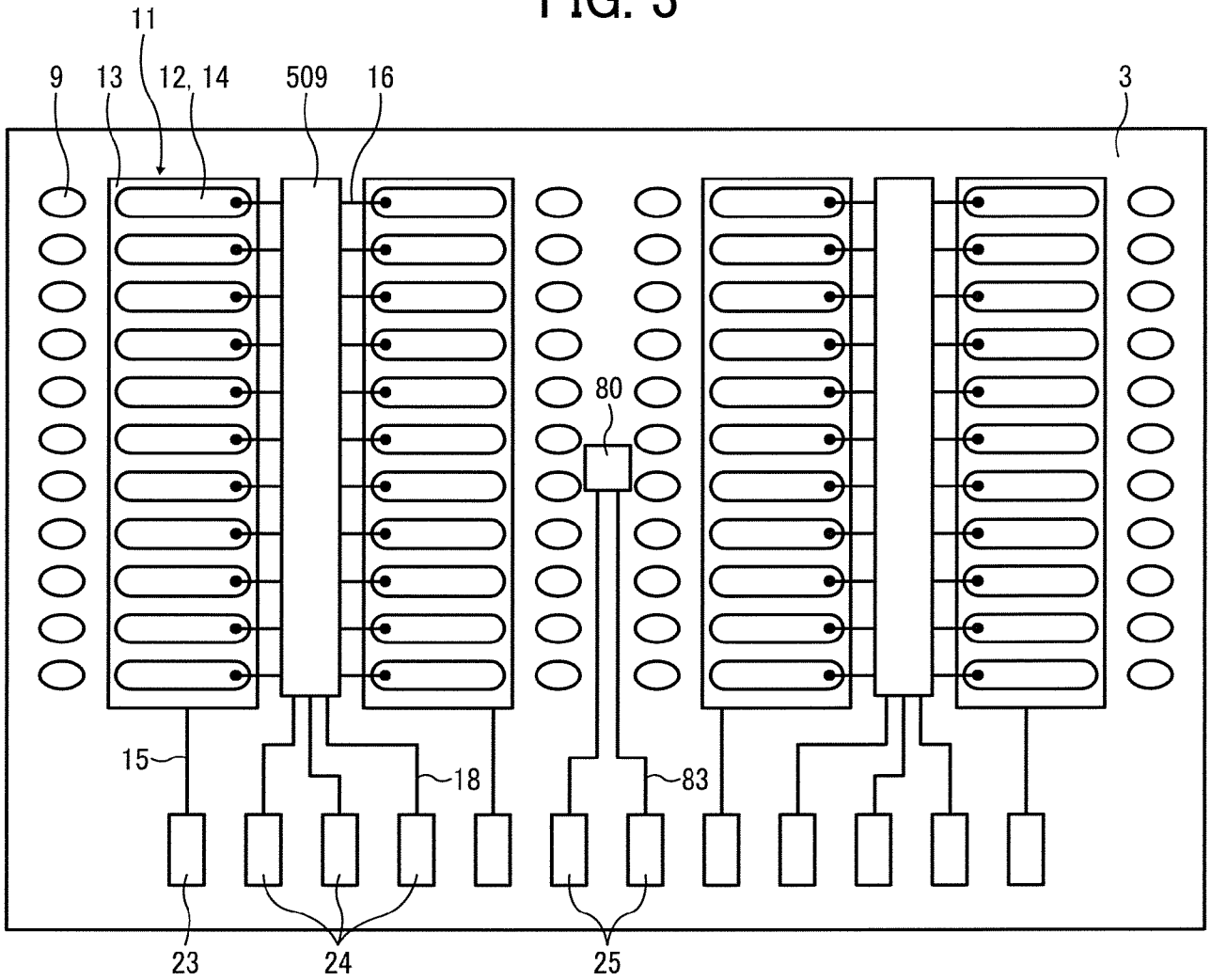
FIG. 3 is a plan view of an actuator substrate in the head.

Embodiments of the present disclosure will be described below with reference to the accompanying drawings. A first embodiment of a liquid discharge head according to the present disclosure will be described with reference to FIGS. 1 through 3. FIG. 1 is a partial cross-sectional view in a direction perpendicular to a nozzle array direction of the head, FIG. 2 is a partial cross-sectional view in the nozzle array direction of the head, and FIG. 3 is a plan view of an actuator substrate of the head.

This liquid discharge head includes a nozzle plate 1, a channel plate 2, a diaphragm member 3, a piezoelectric element 11 that is a pressure generator, a holding substrate 51 that is an opening formation member, and a frame member that doubles as a common liquid chamber member.

It is to be noted that a section composed of the channel plate 2, the diaphragm member 3, and the piezoelectric element 11 is referred to as an "actuator substrate 20" in the present embodiment. However, the section is not considered to represent an independent member joined to the nozzle plate 1, the holding substrate 51, and the frame member after the member is formed as the actuator substrate 20.

The nozzle plate 1 has a plurality of nozzles 4 formed for discharging droplets. In this embodiment, four nozzle rows are arranged which each have nozzles 4 arranged.

The channel plate 2 forms, along with the nozzle plate 1 and the diaphragm member 3, an individual liquid chamber 6 in communication with the nozzle 4, a fluid resistant portion 7 in communication with the individual liquid chamber 6, and a liquid introduction portion (passage) 8 in communication with the fluid resistant portion 7. The individual liquid chamber 6 in communication with the nozzle 4 for discharging droplets, the fluid resistant portion 7, and the liquid introduction portion 8 are all together referred to as an individual channel 5.

The liquid introduction portion 8 of the individual channel 5 communicates with a common liquid chamber formed of the frame member from an opening 110A of the holding substrate 51, through a supply port 9 formed in the diaphragm member 3. In addition, the supply port 9 is shown as a filter with a plurality of filter holes, but may be a simple opening.

The diaphragm member 3 forms a deformable diaphragm (oscillation region) 30 that partially constitutes a wall surface of the individual liquid chamber 6. Further, the diaphragm 30 of the diaphragm member 3 has the piezoelectric element 11 provided on the side opposite to the individual liquid chamber 6 in an integral manner with the diaphragm 30, and the diaphragm 30 and the piezoelectric element 11 constitute a piezoelectric actuator.

The piezoelectric element 11 is composed of a lower electrode 13, a piezoelectric layer (piezoelectric substance layer) 12, and an upper electrode 14 sequentially formed by stacking from the diaphragm 30 side. An interlayer insulating film 21 is formed on the piezoelectric element 11.

The lower electrode 13 of the piezoelectric element 11 is extracted via a common wiring 15, and connected to a connecting pad 23. The upper electrode 14 is extracted via the individual wiring 16, and connected to a driving IC (driver IC) 509.

The driver IC is mounted on the actuator substrate 20 by a method such as flip-chip bonding or wire bonding, so as to cover the region between rows of piezoelectric elements.

Further, the holding substrate 51 which forms a recess (oscillation chamber) 50 for housing the piezoelectric element 11 and a space 52 for wiring are provided over the actuator substrate 20 with a passivation layer 22 interposed therebetween.

The holding substrate 51 is bonded to the diaphragm member 3 side of the actuator substrate 20 with an adhesive.

In the liquid discharge head thus configured, a voltage is applied between the upper electrode 14 and lower electrode 13 of the piezoelectric element 11 from the driver IC to cause the piezoelectric substance layer 12 to extend in the electrode stacking direction, that is, the electric field direction, and contract in a direction parallel to the diaphragm 30.

In this case, because the lower electrode 13 side is restrained by the diaphragm 30, tensile stress is generated on the lower electrode 13 side of the diaphragm 30, and the diaphragm 30 is bent to the individual liquid chamber 6 side to apply pressure on the internal liquid, thereby discharging droplets from the nozzle 4.

Next, specific examples for each member will be described.

The nozzle plate 1 has a plurality of nozzles 4 for discharging droplets. For the material of the nozzle plate 1, any material can be used in terms of required rigidity and workability. Examples of the material can include, for example, SUS, metals such as nickel or alloys, inorganic materials such as silicon and ceramic, and resin materials such as polyimide. For the method of processing the nozzles 4, any method can be selected in terms of material properties and required accuracy and workability, and examples of the method can include an electroforming plating method, an etching method, a pressing process method, a laser processing method, and a photolithography method. As for the opening diameters, arrangement number, and arrangement density of the nozzles 4, an optimum combination can be set in accordance with the specifications required for the head.

While any material can be used in terms of workability and properties for the material of the channel plate 2, it is preferable to use, at 300 dpi (a pitch of approximately 85 μm), a silicon substrate that allows the use of a photolithography method. While the processing of the individual liquid chamber 6, etc., can rely on any processing method, any of wet etching methods and dry etching methods can be used in the case of using a photolithography method. In any approach, a silicon dioxide film or the like adopted as the individual liquid chamber 6 side of the diaphragm member 3 can serve as an etch stop layer, and the chamber height can be thus controlled with a high degree of accuracy.

The individual liquid chamber 6 has the function of discharging droplets from the nozzles 4, with a pressure applied to the liquid. The piezoelectric element 11 having the lower electrode 13, piezoelectric substance layer 12, and upper electrode 14 stacked is formed on the diaphragm member 3 which forms the wall surface of the individual liquid chamber 6.

While any material can be used for the material of the diaphragm member 3, highly rigid materials are preferred such as silicon, nitrides, oxides, and carbides. In addition, a laminated structure of these materials may be adopted. In the case of adopting a laminated film, a composition with low residual stress is preferred in consideration of internal stress for each material. For example, in the case of a laminate of $Si_3N_4$ and $SiO_2$, examples of the laminate include a composition for stress relaxation, which is obtained by alternately laminating $Si_3N_4$ which produces tensile stress and $SiO_2$ which produces compressive stress.

The thickness of the diaphragm member 3 can be selected depending on desired characteristics, but preferably falls within the range of approximately 0.5 μm to 10 μm, further preferably within the range of 1.0 μm to 5.0 μm. The diaphragm 30 becomes more likely to be broken by cracking or the like when the diaphragm member 3 is excessively thin, or the displacement amount is reduced to decrease the discharge efficiency when the member is excessively thick. Furthermore, when the member is excessively thin, the natural frequency of the diaphragm 30 is disadvantageously decreased to result in failure to increase the drive frequency.

Any conductive material can be used for the lower electrode 13 and the upper electrode 14. Examples of the material include metals, alloys, and conductive compounds. Single layer films and laminated films of these materials may be also adopted. In addition, there is a need to select a material that does not react with the piezoelectric substance layer 12, and a material that does not diffuse into the piezoelectric substance layer 12, and there is thus a need to select a highly stable material. In addition, if necessary, an adhesion layer may be formed in consideration of adhesion to the piezoelectric substance layer 12 or the diaphragm member 3. Examples of the electrode materials include Pt, Ir, Ir oxides, Pd, and Pd oxides as highly stable materials. In addition, examples of the adhesion layer to the diaphragm member 3 can include Ti, Ta, W, and Cr.

Ferroelectric material which exhibits piezoelectricity can be used for the material of the piezoelectric substance layer 12. Lead zirconate titanate or barium titanate is commonly used as an example. For the method for forming a film of the piezoelectric substance, any approach can be used, and examples of the method include sputtering methods and sol-gel methods, and sol-gel methods are preferred because of the low film formation temperatures. There is a need for the upper electrode 14 and the piezoelectric substance layer 12 to be subjected to patterning for each individual liquid chamber 6. Common photolithography methods can be used for the patterning. In addition, in the case of forming a film for the piezoelectric substance layer 12 by a sol-gel method, spin coating methods and printing methods can be also used.

There is a need for the piezoelectric element 11 composed of the piezoelectric substance layer 12 and the electrodes 13 and 14 to be formed to correspond to the individual liquid chamber 6. When the piezoelectric element 11 is formed on a partition wall for compartmentalizes the individual liquid chamber 6, a decrease in discharge efficiency, breakage of the piezoelectric element 11 due to stress concentration, etc. are caused because the deformation of the diaphragm 30 is blocked.

The channel plate 2 has, as previously described, the fluid resistant portion 7 formed in communication with the individual liquid chamber 6. The fluid resistant portion has the function of supplying the liquid from a common liquid chamber to the individual liquid chamber 6, and at the same time, has the function of preventing the liquid from flowing back due to the pressure generated in the individual liquid chamber 6 by driving the piezoelectric element 11. Therefore, there is a need to reduce the cross-sectional area of the individual liquid chamber 6 in the fluid flow direction to increase the fluid resistance.

In the case of using a silicon substrate for the channel plate 2, and forming the individual liquid chamber 6 and the fluid resistant portion by a photolithography method (and etching), the fluid resistant portion has the advantage of being able to be processed under the same condition as the individual liquid chamber 6. In order to increase the fluid resistance by making the level of the fluid resistant portion lower than the individual liquid chamber 6, there is a need to control the overetching amount of the individual liquid chamber 6 on a time-management basis, and the fluid resistance is thus unable to be equalized due to the variation in etching rate. As a result, the discharge uniformity will be deteriorated.

The fluid resistant portion communicates with a common liquid chamber through an opening of the diaphragm member 3.

Furthermore, the individual liquid chamber 6 is compartmentalized by partition walls 61, and the piezoelectric element 11 is formed which correspond to each compartment. The height of the individual liquid chamber 6 can be arbitrarily set in view of head characteristics, but preferably falls within the range of 20 to 100 μm. In addition, the partition walls 61 between the individual liquid chambers 6 are able to be arbitrarily arranged in accordance with the arrangement density, but the partition wall widths are preferably 10 to 30 μm. In addition, when the partition wall 61 is narrow in width, in the case of driving the piezoelectric element 11 for the next individual liquid chamber 6, mutual interference between adjacent liquid chambers is generated to increase the discharge variation. In the case of narrowing the widths of the partition walls 61, the height of the individual liquid chamber 6 is correspondingly decreased.

In order to provide a driving signal to the arranged piezoelectric elements 11 from the driving IC 509, the individual wirings 16 are extracted from the upper electrodes 14, whereas the common wiring 15 is extracted from the lower electrodes 13. The upper electrodes 14 are connected to the driving IC 509 via the individual wirings 16 that partially constitute metal layers, and extracted from the driving IC 509 via extraction wirings 18 to connecting pads 24. The lower electrodes 13 are extracted via the common wiring 15 to the connecting pad 23.

The individual wirings 16 and the common wiring 15 are preferably formed from the same material in the same process. Metals, alloys, and conductive materials which are low in resistance value can be used as the wiring material.

Furthermore, there is a need to use, for the individual wirings 16 and the common wiring 15, a material that is low in contact resistance against the upper electrodes 14 and the lower electrodes 13. Examples of the material can include Al, Au, Ag, Pd, Ir, W, Ti, Ta, Cu, and Cr, and laminated structures of these materials may be adopted in order to reduce the contact resistance. Any conductive compound may be used as a material for lowering the contact resistance. Examples of the material include oxides such as $Ta_2O_5$, $TiO_2$, TiN, ZnO, $In_2O_3$, and SnO, nitrides, and composite compounds thereof.

The film thicknesses of the individual wirings 16 and common wiring 15 can be arbitrarily set, but preferably 3 μm or less. In addition, it is preferable to adopt, for the film formation, a film formation method with high film thickness uniformity, such as a vacuum film formation method.

The individual wirings 16 and the common wiring 15 also serve as partition walls for joining to the holding substrate 51, and there is thus a need to adopt the film thicknesses and film formation method which can ensure uniformity in height. More specifically, the metal layer is placed so as to surround the supply ports 9. Around the supply ports 9, sealing performance is required, because the openings of the holding substrate 51 and of the channel plate 2 are joined to each other. Thus, in order to enhance uniformity in height on the channel plate 2 side, the metal layer is formed around the supply ports 9 to enhance the reliability.

The holding substrate 51 is, because the channel plate 2 is thin from 20 to 100 μm in thickness, intended to ensure the rigidity of the channel plate 2, and joined on the side opposed to the nozzle plate 1. While any material can be used for the material of the holding substrate 51, it is preferable to select a material that close in coefficient of thermal expansion, in order to prevent warpage of the channel plate 2. Preferred are, for example, glass, silicon, ceramics materials such as $SiO_2$, $ZrO_2$, and $Al_2O_3$.

The holding substrate 51 has an opening that forms a part of the common liquid chamber, and forms the recess (oscillation chamber) 50 in a region corresponding to the individual liquid chamber 6, thereby ensuring a space for the diaphragm 30 to be able to be displaced by driving the piezoelectric element 11. This recess 50 is preferably compartmentalized for each individual liquid chamber 6, and joined on the partition wall 61 of the individual liquid chamber 6. Thus, the channel plate 2 which is thin in plate thickness can be enhanced in terms of rigidity, and mutual interference between adjacent liquid chambers can be reduced when the piezoelectric element 11 is driven. To that end, the holding substrate 51 is preferably a high rigidity material such as silicon, rather than a low rigidity material such as resins. Furthermore, because the recess 50 of the holding substrate 51 is compartmentalized for each individual liquid chamber 6, a high degree of processing accuracy is required for density growth, and the partition wall width of the recess 50 is preferably 5 to 20 μm in the case of a 300 dpi head.

Figure 4:
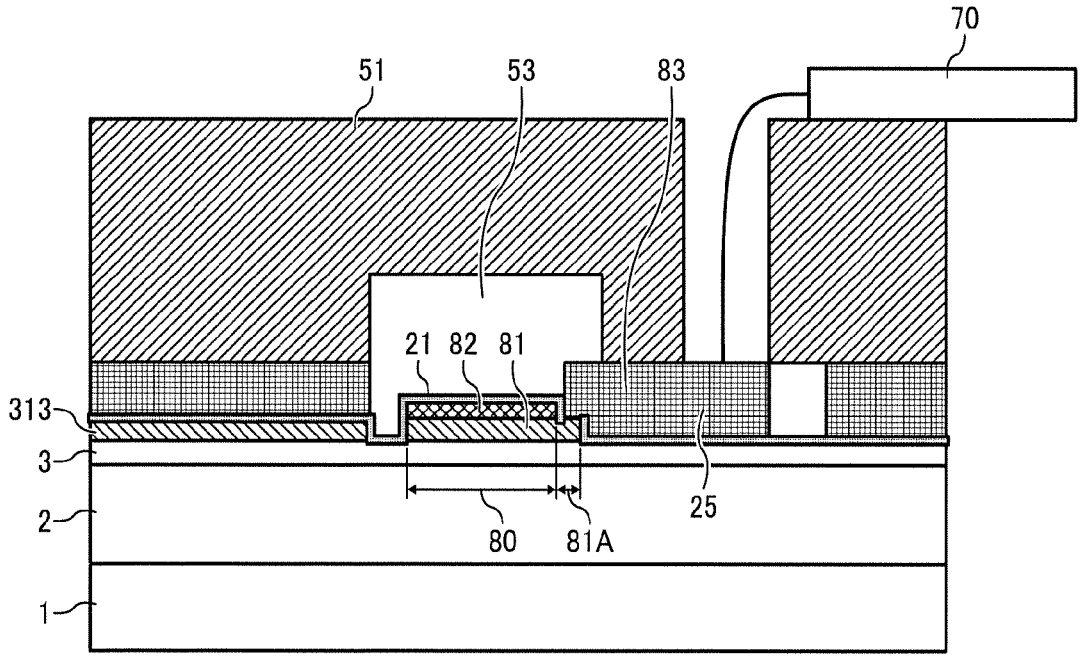
FIG. 4 is a partial cross-sectional view around a temperature detection unit in the head.

Next, a temperature detection unit according to an embodiment of the present disclosure in the liquid discharge head will be described also with reference to FIG. 4. FIG. 4 is a partial cross-sectional view around the temperature detection unit of the head. FIG. 4 has cross-section hatching partially omitted for facilitating visualization.

A temperature detection unit 80 as a temperature detector is placed on the diaphragm member 3, and composed of an electrode layer 81 that serves as a resistance temperature detector, which is formed on the diaphragm member 3.

Further, a piezoelectric substance layer 82 is formed on the electrode layer 81 that serves as a resistance temperature detector. In addition, the electrode layer 81 that serves as a resistance temperature detector has a wiring lead portion 81A integrally formed. The piezoelectric substance layer 82 is not formed on the wiring lead portion 81A, to which an electrode wiring 83 is directly connected.

In this case, the electrode layer 81 is formed of the layer forming the lower electrode 13 of the piezoelectric element 11, and the piezoelectric substance layer 82 is formed of the piezoelectric material layer forming the piezoelectric substance layer 12 of the piezoelectric element 11.

Thus, there is no need to add any dedicated material or process for the resistance temperature detector constituting the temperature detector. Moreover, the head can be prevented from undergoing an increase in size, because there is no need for any region either for the resistance temperature detector constituting the temperature detector.

The electrode layer 81 is extracted with the electrode wiring 83, and connected to a connecting pad 25 in the same manner as the lower electrode 13.

It is to be noted that the temperature detection unit 80 has been described with an example of one unit placed in a central region of the diaphragm member 3, but not to be considered limited to this example. The unit can be also placed in other than the central region of the diaphragm member 3. Alternatively, more than one unit can be placed, which can detect the head temperature with a higher degree of accuracy.

In order to detect the temperature with the temperature detection unit 80, the temperature can be estimated from the voltage value in the case of applying a constant current from an external circuit to the electrode layer 81. Pt is most preferred as the electrode layer 81. Pt resistance temperature detectors are optimum as temperature sensors, e.g., as in the adoption thereof for standard thermometers with the international temperature scale, because of the highest degree of accuracy as resistance temperature detectors, high linearity, excellent corrosion resistance and temporal stability, etc.

As just described above, the piezoelectric substance layer 82 is formed on the electrode layer 81 that functions as a temperature sensor (resistance temperature detector), and thus, in the formation of the temperature detection unit 80 in the process of forming the piezoelectric element 11, the piezoelectric substance layer 82 serves as an etching-resistant layer while the electrode layer 81 is subjected to patterning.

Accordingly, as will be described later, a high degree of processing width accuracy is achieved without any film loss by overetching.

The resistance of a resistance temperature detector is, as is known, proportional to the resistivity and the pattern length, and inversely proportional to the width and height of the cross section. Therefore, the formation of the electrode layer 81 by etching with the piezoelectric substance layer (ceramic layer) 82 as an etching-resistant layer as described above can form the width and the height with a high degree of accuracy, and reduce the variation in resistance. The reduced variation in resistance also reduces the variation in temperature detected, thereby allowing high-accuracy discharge control through high-accuracy temperature detection.

Furthermore, a recess 53 is formed in a region of holding substrate 51, which is opposed to the temperature detection unit 80, in such a way that the holding substrate 51 keeps from interfering with the piezoelectric substance layer 82 of the temperature detection unit 80 when the holding substrate 51 is joined to the diaphragm member 3 in the head assembling process.

Next, an example of a method for manufacturing a liquid discharge head according to an embodiment of the present disclosure will be described with reference to FIGS. 5A to 5G.

Figure 5A:
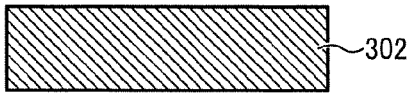
FIGS. 5A to 5G are diagrams illustrating an example of a method for manufacturing a liquid discharge head according to an embodiment of the present disclosure.
Figure 5B:
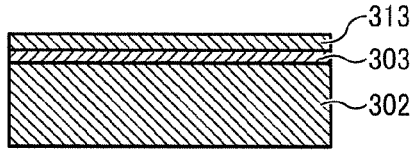

First, a silicon wafer 302 of 6 inches and 600 μm in thickness is prepared which serves as the channel plate 2, as shown in FIG. 5A. Then, as shown in FIG. 5B, a diaphragm member 303 of three-layer structure is formed by laminating an SiO2 film of 0.6 μm in thickness, a Si film of 1.5 μm in thickness, and a SiO2 film of 0.4 μm in thickness. Furthermore, on the diaphragm member 303, a Ti film of 20 nm in thickness and a Pt film of 200 nm in thickness are formed by a sputtering method as an electrode formation layer 313 that serves as the lower electrode 13 and the electrode layer 81.

Figure 5C:
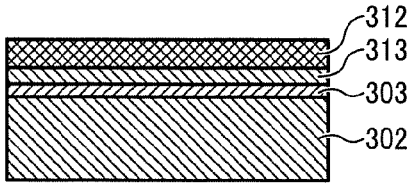

Then, as shown in FIG. 5C, on the electrode formation layer 313, a film of 2 μm in thickness, for lead zirconate titanate (PZT) that serves as the piezoelectric substance layer 12 and the piezoelectric substance layer (ceramic layer) 82, is formed by a sol-gel method with the use of an organometallic solution, and subjected to firing at 700° C. to form a PZT piezoelectric substance film 312.

Figure 5D:
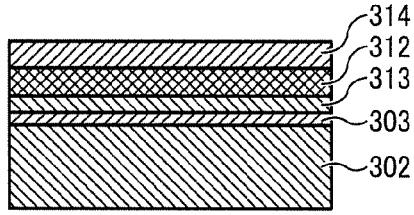

Then, as shown in FIG. 5D, on the piezoelectric substance film 312, a Pt film of 200 nm in thickness is formed by a sputtering method as an electrode formation layer 314 that serves as the upper electrode 14.

Figure 5E:
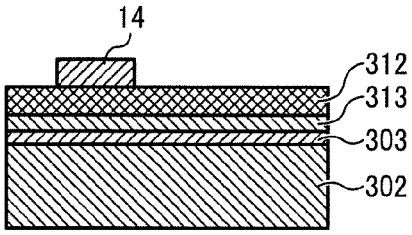

Thereafter, as shown in FIG. 5E, the electrode formation layer 314 is subjected to patterning by a dry etching method to form the upper electrode 14. In this case, a portion of the electrode formation layer 314 is removed for the temperature detection unit 80.

Figure 5F:
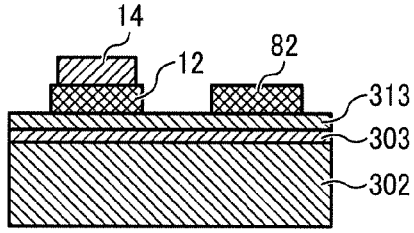

Then, as shown in FIG. 5F, the piezoelectric substance film 312 is subjected to patterning by a dry etching method to form the piezoelectric substance layer 12 and the piezoelectric substance layer 82.

Figure 5G:
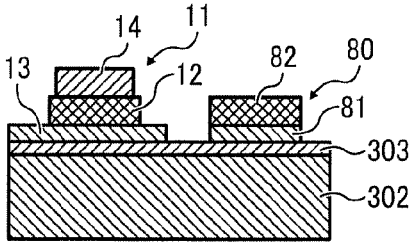

Moreover, as shown in FIG. 5G, the electrode formation layer 313 is subjected to patterning by a dry etching method to form the lower electrode 13 and the electrode layer 81.

In this case, a resist is adopted as the etching-resistant layer for the lower electrode 13, whereas the piezoelectric substance layer 82 is adopted as the etching-resistant layer for the electrode layer 81.

In summary, carried out are: a step of forming a layer (electrode formation layer 313) to serve as the lower electrode 13 on the diaphragm member 3; a step of forming a layer (piezoelectric substance film 312) to serve as the piezoelectric substance layer 12 on the layer (electrode formation layer 313) which forms the lower electrode 13; a step of processing the layer (piezoelectric substance film 312) to serve as the piezoelectric substance layer 12 to form the piezoelectric substance layer 12 and the piezoelectric substance layer 82; and a step of etching the layer (electrode formation layer 313) to serve as the lower electrode 13 with the piezoelectric substance layer 82 as an etching-resistant layer to form the electrode layer 81.

In this case, the processing accuracy in the formation of the piezoelectric substance layer 12 is adjusted to an extremely high degree of accuracy, due to the fact that the processing accuracy makes a large contribution to droplet discharge characteristics. On the other hand, due to the fact that the processing accuracy in the formation of the lower electrode 13 makes a small contribution to the droplet discharge characteristics, a high degree of processing accuracy is not required for the processing accuracy in consideration of cost.

Therefore, the processing accuracy is low for the resist which is an etching-resistant layer for the lower electrode 13 of the piezoelectric element 11. However, the processing accuracy is an extremely high degree of accuracy for the piezoelectric substance layer (ceramic layer) 82 which serves as an etching-resistant layer in the formation of the electrode layer 81 constituting the temperature detection unit 80, and the processing accuracy for the electrode layer 81 which serves as a resistance temperature detector is thus also a high degree of accuracy.

Accordingly, high-accuracy temperature detection can be carried out, with small variations in the resistance value and temperature coefficient of the electrode layer 81 which serves as a resistance temperature detector.

In contrast, when a resist is used as an etching-resistant layer in the processing of the electrode layer 81 which serves as a resistance temperature detector, the resist may be removed to cause the electrode formation layer 313 to suffer from a film loss. Therefore, when the electrode layer 81 is processed with a resist as an etching-resistant layer, due to the low processing accuracy, a film loss may be caused, and the resistance and the temperature coefficient of resistance disadvantageously vary to decrease the detection accuracy.

In this regard, a supplementary statement will be made. When a resist is used as the etching-resistant film, etching the electrode formation layer 313 in the step of FIG. 5F also etches the resist itself to even etch the electrode formation layer 313 covered with the resist, thereby causing a film loss by overetching. Therefore, the electrode layer 81 which serves as a resistance temperature detector will vary in form to decrease the measurement accuracy.

In contrast, as in the present embodiment, when a piezoelectric substance layer (film) is used as the etching-resistant film, the piezoelectric substance layer itself is not etched in the step of FIG. 5F, or the electrode formation layer 313 covered with the piezoelectric substance layer is thus not etched either. Thus, the electrode layer 81 which serves as a resistance temperature detector can be processed into a predetermined form with a high degree of accuracy, and high-accuracy measurements can be made.

In addition, on the grounds that the piezoelectric substance layer 82 is not removed after the electrode layer 81 is processed into a resistance temperature detector, the shape of the resistance temperature detector can be maintained which is obtained by high-accuracy processing. More specifically, when etching is carried out for removing the piezoelectric substance layer 82 after the processing into the resistance temperature detector, there is a possibility that the processed resistance temperature detector will be even etched to change the shape thereof. Thus, the shape of the electrode layer 81 to serve as a resistance temperature detector can be maintained with a high degree of accuracy by keeping the piezoelectric substance layer 82 as it is.

It is to be noted that herein, the piezoelectric element 11 has an arrangement pitch adjusted to 85 μm, whereas the piezoelectric substance layer 12 has a width adjusted to 40 μm. The piezoelectric element 11 has a length adjusted to 1000 μm in a longitudinal direction. The arrangement number of piezoelectric elements 11 is adjusted to 300. The electrode layer 81 to serve as a resistance temperature detector is formed to have a width of 50 μm.

Next, a process after the process in FIGS. 5A to 5G will be described.

After the formation of the piezoelectric element 11, the interlayer insulating film 21 is formed by a plasma CVD method, and on the upper electrode 14, a contact hole for individual wiring and a contact hole for common wiring are formed in the interlayer insulating film 21. Then, a Ti film of 50 nm in thickness and an Al film of 2 μm in thickness are sequentially laminated, and subjected to dry etching to form a metal layer, thereby forming the individual wiring 16 and the common wiring 15, and a metal layer around the supply port 9. The common wiring 15 has a width adjusted to 300 μm.

In this case, a contact hole is also formed in the same manner on the electrode layer 81 to serve as a resistance temperature detector, and wiring is extracted in the same manner as described above.

Thereafter, the diaphragm member 3 corresponding to the supply port 9 is removed by dry etching to form the supply port 9 composed of a simple opening, and a liquid introduction portion corresponding to the supply port 9 is formed in the channel plate 2.

On the other hand, the holding substrate 51 is manufactured with the use of a silicon wafer of ϕ 6 inches.

First, the wafer is polished to a thickness of 400 μm, and an oxide film or the like is formed on the channel plate 2 side. Thereafter, the oxide film is subjected to photolithographic patterning, so as to form openings for the recess 50 of the holding substrate 51 and the opening of the holding substrate 51. Then, a resist is further formed thereon, and subjected to photolithographic patterning, so as to form an opening only for the opening of the holding substrate 51.

Then, an opening is formed by ICP etching to pass through the substrate from the channel plate 2 side. Thereafter, only the resist on the channel plate 2 side is removed, and with the oxide film pattern first subjected to patterning as a mask, the channel plate 2 side is subjected to half etching by ICP etching. Finally, when the oxide film is removed, the recess 50 on the channel plate 2 side and the through opening can be formed.

To a joint surface of the prepared holding substrate 51, an epoxy adhesive of 2 μm film thickness is applied for joining with a flexographic printing machine, and the adhesive is subjected to curing to join the holding substrate 51 to the channel plate 2. Of the channel plate 2, the electrode layer 81 to serve as a resistance temperature detector and the metal layer around the supply port 9 are mainly joined to the holding substrate 51. The joining can be achieved without any problems, because the layer thicknesses are made comparable as described above.

Thereafter, the driving IC 509 is mounted on the diaphragm member 3 by flip-chip bonding.

Thereafter, the channel plate 2 of 600 μm is polished down to 80 μm, and the individual liquid chamber 6 and the fluid resistant portion are then formed by an ICP dry etching method.

The individual liquid chamber 6 has a width adjusted to 60 μm, and the fluid resistant portion has a width adjusted to 30 μm and a length adjusted to 300 μm. The fluid resistant portion and the individual liquid chamber 6 are etched until reaching the diaphragm member 3, so as to be equal in height. In addition, the through-hole can be formed, because the diaphragm member 3 corresponding to the supply port is etched in advance.

Then, after the wafer is cut out into a chip by dicing, the nozzle plate 1 and the channel plate 2 are joined in the same approach as the holding substrate 51. For the nozzle plate 1, a SUS material of 30 μm in thickness is used which has nozzles 4 of ϕ20 μm formed at a pitch of 85 μm by a pressing process.

Then, a common liquid chamber member (frame member) made of SUS is joined onto the holding substrate 51.

Figure 6:
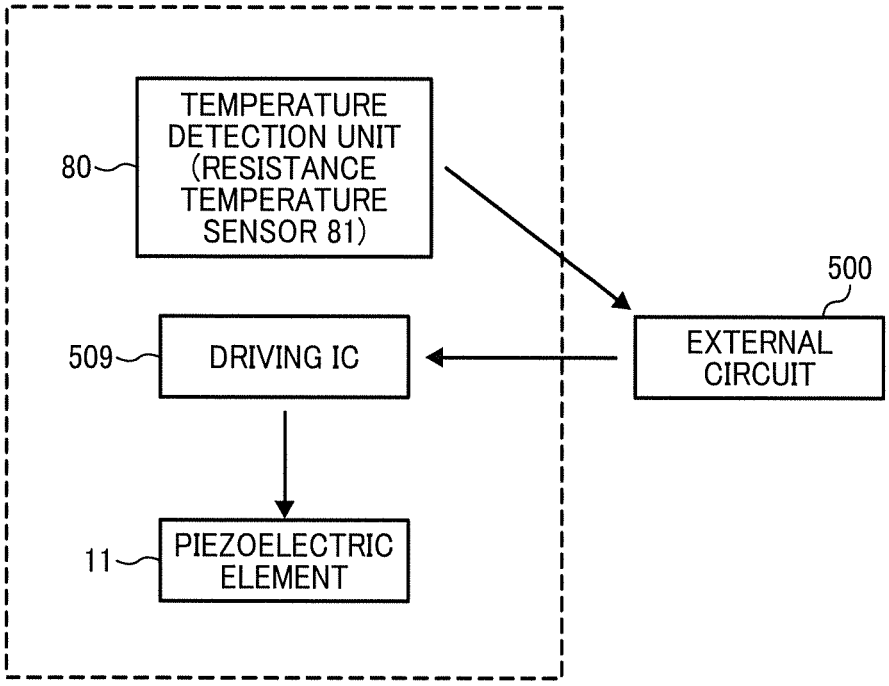
FIG. 6 is a block diagram of a section related to head drive control.

FPCs 70 are joined by wire bonding to the connecting pads 23 to 25 of the thus obtained liquid discharge head, and connected to an external circuit 500 as shown in FIG. 6.

The external circuit 500 includes a controller, etc. that generally control the image forming apparatus, selects a driving waveform for driving the piezoelectric element 11 depending on the head temperature detected by the temperature detection unit 80 (the electrode layer 81 as a resistance temperature detector), and controls the driving of the piezoelectric element 11 via the driving IC 509.

Figure 7:
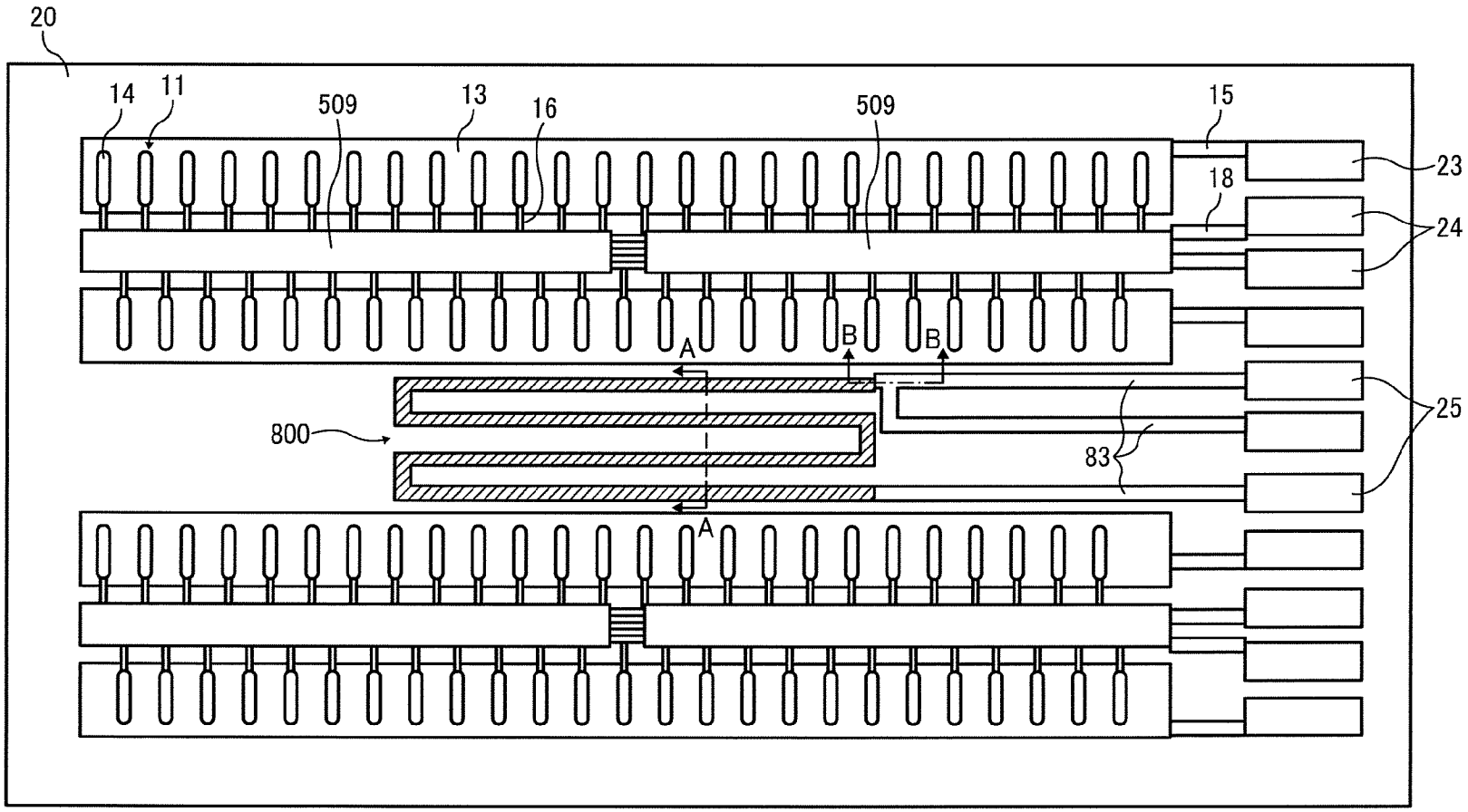
FIG. 7 is a plan view of an actuator substrate in a second embodiment of a liquid discharge head according to the present disclosure.
Figure 8:
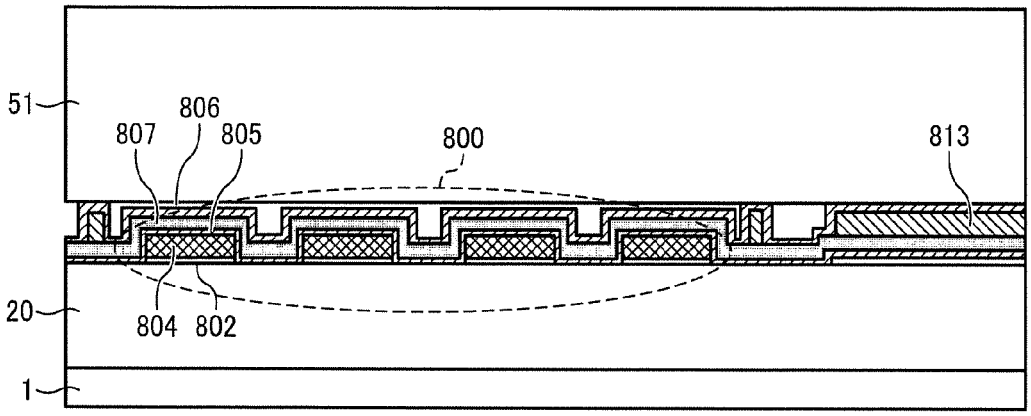
FIG. 8 is a cross-sectional view of FIG. 7 along the line A-A.
Figure 9:
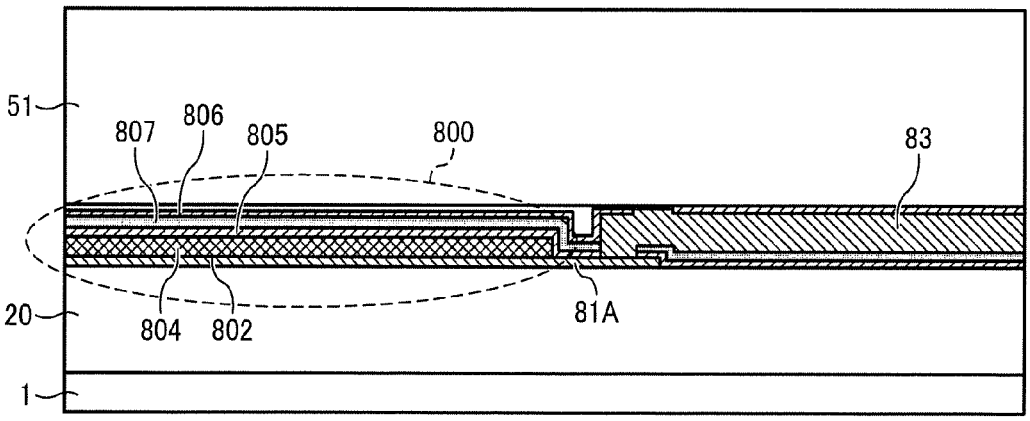
FIG. 9 is a cross-sectional view of FIG. 7 along the line B-B.

Next, another embodiment of a liquid discharge head according to the present disclosure will be described with reference to FIGS. 7 through 9. FIG. 7 is a plan view of an actuator substrate according to the embodiment, FIG. 8 is a cross-sectional view of FIG. 7 along the line A-A, and FIG. 9 is a cross-sectional view of FIG. 7 along the line B-B.

A temperature detection unit 800 according to the present embodiment has the following layer configuration. More specifically, a titanium oxide film (adhesion film), a platinum film 802, a conductive oxide (SRO), a piezoelectric film (piezoelectric substance layer) 804, an aluminum oxide film 805, and an SiO2 film 806 and an SiN film 807 as insulating films are laminated sequentially from the diaphragm member 3 side (actuator substrate 20 side).

In this case, the platinum layer 802 is a film (layer) that functions as a resistance temperature detector. The aluminum oxide film 805 functions as a protective film for protecting the piezoelectric element from moisture.

In the temperature detection unit 800, the resistance temperature detector (platinum layer 802) and the piezoelectric film 804 are formed, in a plan view, in an accordion line shape with more than one (three or more) folds.

In addition, the platinum film 802 which functions as a resistance temperature detector and the piezoelectric film 804 are surrounded by the SiO2 film 806 and SiN film 807 as an insulating films.

Furthermore, the piezoelectric film 804 is not formed at both ends of the line-shaped platinum film 802, but at the ends, the platinum film 802 is connected to a wiring 83.

In this case, for the connection between the platinum film 802 and the wiring 83, a through-hole is formed in the aluminum oxide film 805 and insulating film (SiO2 film 806) on the platinum film 802, and the platinum film 802 and the wiring 83 are brought in continuity with each other via the through-hole.

Furthermore, in the present embodiment, a holding substrate 51 has no recess (the recess 53 in the first embodiment) formed which corresponds to the temperature detection unit 800.

More specifically, in the present embodiment, an aluminum wiring layer (Al) 813 that forms the wiring 83 is provided in the vicinity of the temperature detection unit 800, the head of the wiring layer 813 is positioned higher than the head of the piezoelectric film 804, and the holding substrate 51 is joined to the actuator substrate 20 via the wiring layer. Thus, the holding substrate 51 and the temperature detection unit 800 are adapted so as not to heightwise interfere with each other.

In addition, in the present embodiment, the three-wire connection is adopted as the method for connecting the resistance temperature detector (platinum layer 802) of the temperature detection unit 800, in such a way that the three wirings 83 are used to keep the resistance value of the wirings themselves from affecting measurement results. As the material of the wirings 83, aluminum (Al) is used as described above.

It is to be noted that the wirings 83 and connecting pads 25 are formed from the same aluminum wiring layer 813, and the connecting pads 25 are formed to be larger in width than the wirings 83. The wiring layer 813 other than the connecting pads is coated with the insulating film (SiN film 807). In addition, the connecting pads 25 are electrically connected by wire bonding to terminals of a wring member (on the FPC side).

Figure 10:
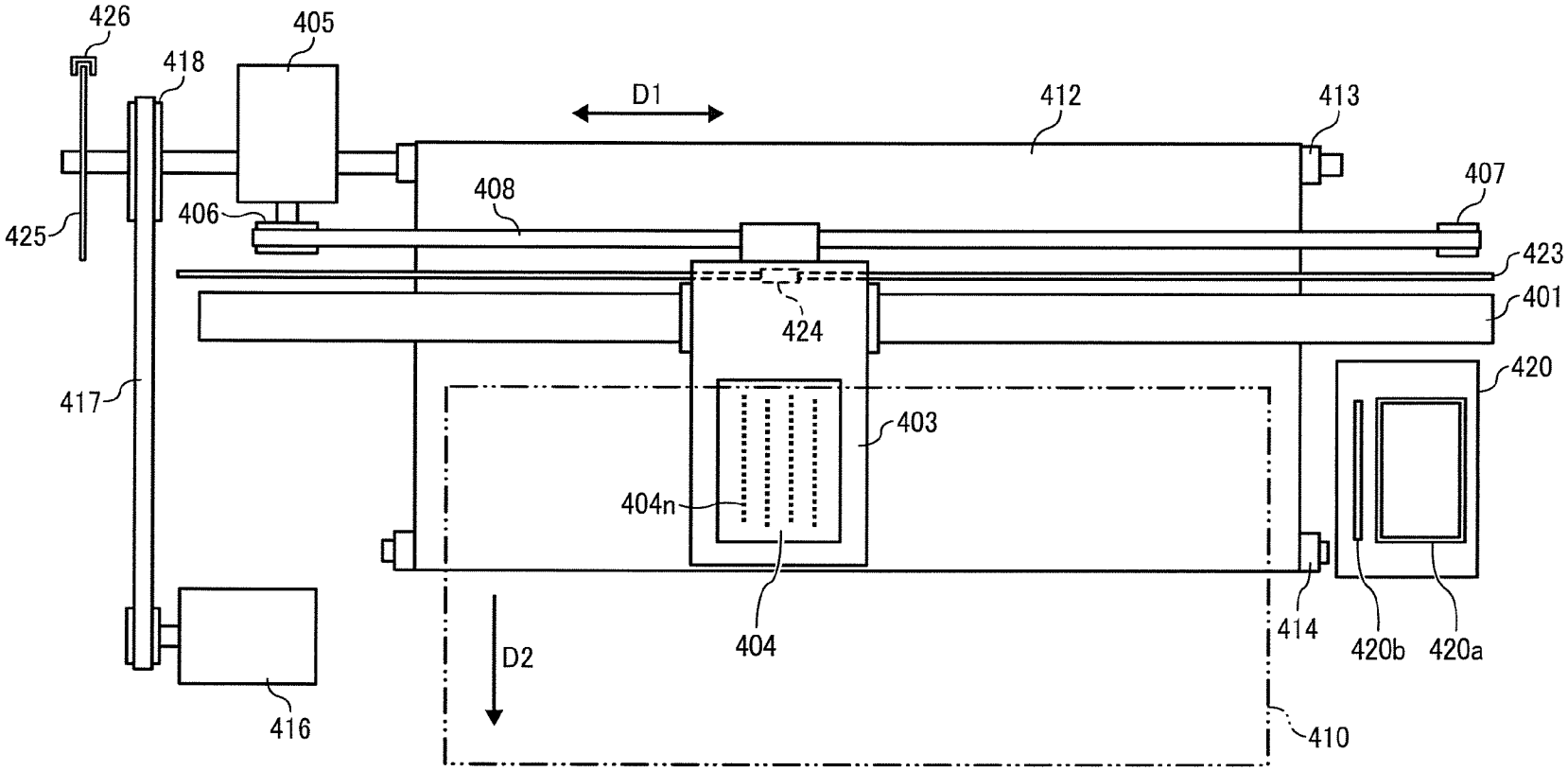
FIG. 10 is a plan view of an example of an image forming apparatus according to an embodiment of the present disclosure.

Next, an example of an image forming apparatus according to an embodiment of the present disclosure will be described with reference to FIG. 10. FIG. 10 is a plan view of the image forming apparatus.

This image forming apparatus is a serial type ink-jet recording apparatus, where movably holds a carriage 403 with a main guide 401 bridged laterally on right and left side plates and a sub guide. Furthermore, a main scanning motor 405 shuttles the carriage in a main scanning direction (carriage movement direction), which is indicated by arrow D1 in FIG. 10, through a timing belt 408 bridged between a driving pulley 406 and a driven pulley 407.

This carriage 403 is equipped with a recording head 404 composed of a liquid discharge head according to an embodiment of the present disclosure. The recording head 404 has four nozzle rows **404*n* that discharge ink droplets in respective colors of, for example, yellow (Y), cyan (C), magenta (M), and black (K). In addition, the recording head 404 is placed with the nozzle rows 404*n*** composed of more than one nozzle in a sub-scanning direction perpendicular to the main scanning direction D1, and attached with the droplet discharge direction downward.

On the other hand, in order to convey a paper sheet 410, a conveyance belt 412 is provided which is a conveyor for conveying the paper sheet by electrostatic adsorption in a position opposed to the recording head 404. This conveyance belt 412 is an endless belt, which is bridged between a conveyance roller 413 and a tension roller 414.

Furthermore, the conveyance belt 412 is circulated in the sub-scanning direction indicated by arrow D2 in FIG. 10 when the conveyance roller 413 is rotary-driven through the timing belt 417 and the timing pulley 418 by a sub-scanning motor 416. This conveyance belt 412 is charged (provided with electric charges) by a charging roller while being circulated.

Furthermore, a maintenance assembly 420 for the maintenance of the recording head 404 is placed at a lateral side of the conveyance belt 412 at one end in the main scanning direction D1 of the carriage 403, whereas a dummy discharge receiver for dummy discharge from the recording head 404 is placed at a lateral side of the conveyance belt 412 at the other end of the main scanning direction D1.

The maintenance assembly 420 is composed of, for example, a cap **420*a* for capping a nozzle face (a face with nozzles 4 formed) of the recording head 404, and a wiper member 420*b*** for sweeping the nozzle face.

In addition, an encoder scale 423 with a predetermined pattern formed is extended between the both side plates in the main scanning direction D1 of the carriage 403, and the carriage 403 is provided with an encoder sensor 424 composed of a transmissive photosensor for reading the pattern of the encoder scale 423. The encoder scale 423 and the encoder sensor 424 constitute a linear encoder (main scanning encoder) that detects movements of the carriage 403.

In addition, a code wheel 425 is attached to the shaft of the conveyance roller 413, and this code wheel 425 is provided with an encoder sensor 426 composed of a transmissive photosensor for detecting a pattern formed. The code wheel 425 and the encoder sensor 426 constitute a rotary encoder (sub-scanning encoder) that detects the travel distance and movement position of the conveyance belt 412.

In the image forming apparatus thus configured, the paper sheet 410 is fed from a sheet feeding tray onto the charged conveyance belt 412, and adsorbed thereon, and the paper sheet 410 is conveyed in the sub-scanning direction D2 by the circulation of the conveyance belt 412.

Thus, ink droplets are discharged to the paper sheet 410 at a stop to record one line, by driving the recording head 404 in response to image signals while moving the carriage 403 in the main scanning direction D1. Then, after conveying the paper sheet 410 by a predetermined amount, the next line is recorded. The recording operation is ended by receiving a recording end signal, or a signal when the rear end of the paper sheet 410 reaches the recording region, and the paper sheet 410 is ejected into an ejection tray.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another. The term "image formation" is used as a synonym for "recording" or "printing".

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation, such as recording liquid and fixing solution.

The term "image" used herein is not limited to a two-dimensional image and includes, for example, an image applied to a three dimensional object and a three dimensional object itself formed as a three-dimensionally molded image.

The term "image forming apparatus" includes both serial-type image forming apparatus and line-type image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a channel plate including an individual liquid chamber in communication with a nozzle to discharge a droplet;

a diaphragm member forming part of a wall face of the individual liquid chamber;

a piezoelectric element disposed on the diaphragm member and including a lower electrode, a piezoelectric substance, and an upper electrode;

a temperature detector disposed on the diaphragm member and including an electrode layer formed on the diaphragm member and a piezoelectric substance layer formed on the electrode layer;

a wiring lead portion of the electrode layer extending beyond an end face of the piezoelectric substance layer; and an electrode wiring connected to the wiring lead portion.

2. The liquid discharge head according to claim 1, wherein the piezoelectric substance layer is the same layer as a layer forming the piezoelectric substance, the electrode layer is the same layer as a layer forming the lower electrode, and the electrode layer is a layer etched with the piezoelectric substance layer serving as an etching-resistant layer.

3. The liquid discharge head according to claim 1, further comprising an insulating film disposed on the piezoelectric substance layer, wherein the insulating film coats a surface of the wiring lead portion, excluding a connection between the wiring lead portion and the electrode wiring.

4. An image forming apparatus comprising the liquid discharge head according to claim 1.

5. A method for manufacturing the liquid discharge head according to claim 1, the method comprising the steps of:

forming a first layer on the diaphragm member;

forming a second layer on the first layer;

processing the second layer to form the piezoelectric substance and the piezoelectric substance layer; and etching the first layer with the piezoelectric substance layer serving as an etching-resistant layer, to form the electrode layer, the electrode layer including a wiring lead portion extending beyond an end face of the piezoelectric substance layer; and connecting an electrode wiring to the wiring lead portion.

* * * * *